US006907872B2

(12) United States Patent
Hamada et al.

(10) Patent No.: US 6,907,872 B2
(45) Date of Patent: Jun. 21, 2005

(54) IGNITION COIL APPARATUS FOR INTERNAL COMBUSTION ENGINE

(75) Inventors: Kazuya Hamada, Tokyo (JP); Takeshi Shimizu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/785,077

(22) Filed: Feb. 25, 2004

(65) Prior Publication Data

US 2005/0045166 A1 Mar. 3, 2005

(30) Foreign Application Priority Data

Aug. 27, 2003 (JP) ..... 2003-303347

(51) Int. Cl.[7] ..... F02P 3/00; H01F 27/40

(52) U.S. Cl. ..... 123/634; 336/96; 336/92; 336/205; 336/211

(58) Field of Search ..... 123/634; 336/84 R, 336/84 C, 90, 92, 96, 205, 211, 221

(56) References Cited

U.S. PATENT DOCUMENTS 4,926,152 A * 5/1990 Ito et al. ..... 336/90
4,986,233 A * 1/1991 Akagi et al. ..... 123/634
5,257,611 A * 11/1993 Chapekis et al. ..... 336/96
5,313,927 A * 5/1994 Takaishi ..... 123/634
5,349,320 A * 9/1994 Suzuki et al. ..... 336/92
5,497,756 A * 3/1996 Matthiesen et al. ..... 123/634
6,107,790 A * 8/2000 Sawazaki et al. ..... 123/634

FOREIGN PATENT DOCUMENTS

JP 08-022924 A 1/1996

* cited by examiner

*Primary Examiner*—Erick Solis
(74) *Attorney, Agent, or Firm*—Sughrue Mion, PLLC

(57) ABSTRACT

An ignition coil apparatus for an internal combustion engine does not generate a discharge between a high-voltage terminal and an iron core even if a high-voltage cable falls off from a high-voltage side connector, and the overall height thereof can be reduced. An ignition coil has an iron core disposed in a casing to form a closed magnetic circuit, and primary and secondary coils installed on a part of the iron core. A power switch controls electric power supplied to the primary coil. A low-voltage side connector has a terminal electrically connected with the power switch. A high-voltage side connector has a high-voltage terminal electrically connected with the secondary coil. The casing includes a casing main body accommodating the part of the iron core, the primary and secondary coils and the power switch, and a cover integral with the main body for covering a part of the iron core located outside thereof.

10 Claims, 5 Drawing Sheets

IGNITION COIL APPARATUS FOR INTERNAL COMBUSTION ENGINE

BACKGROUND OF THE INVENTION

1. Field of the Invention

The present invention relates to an ignition coil apparatus for an internal combustion engine that supplies a high-voltage current to spark plugs through a high-voltage terminal by interrupting a primary current of a primary coil to generate a high voltage in a secondary coil.

2. Description of the Related Art

In the past, there has been known an ignition coil apparatus for an internal combustion engine which includes: a casing; an ignition coil having an iron core that forms a closed magnetic circuit a part of which is arranged in the casing, and a primary coil and a secondary coil installed on parts of the iron core; an ignition control circuit for controlling electric current supplied to the primary coil; a low-voltage side connector having a terminal electrically connected with the ignition control circuit; a high-voltage side connector having a high-voltage terminal electrically connected with the secondary coil; wherein a high voltage induced in the secondary coil upon interruption of primary current of the primary coil is supplied to spark plugs through the high-voltage terminal (for example, see a first patent document: Japanese patent application laid-open No. H08-22924).

In the known ignition coil apparatus for an internal combustion engine, part of the iron core is exposed to air outside of the casing so as to form an earth body. Therefore, there is a fear that if a sufficient distance between the iron core and the high-voltage terminal is not ensured when a high-voltage cable connected with the high-voltage terminal falls off from the high-voltage terminal, there might take place a discharge between the high-voltage terminal and the iron core.

Accordingly, it is necessary to ensure a sufficient distance between the high-voltage terminal and the iron core, but this results in a problem that the overall height of the apparatus becomes large, for instance. In addition, there is also another problem that it is necessary to apply a painting treatment to those surface portions of the iron core which are exposed to air, for the purpose of corrosion protection.

SUMMARY OF THE INVENTION

Accordingly, the present invention is intended to obviate the above-mentioned various problems, and has its object to provide an ignition coil apparatus for an internal combustion engine which is capable of preventing the occurrence of a discharge between a high-voltage terminal and an iron core even if a high-voltage cable falls off from the high-voltage terminal, and of reducing the overall height thereof while removing the necessity of applying, as corrosion protection, a painting treatment to a surface of the iron core.

Bearing the above object in mind, the present invention resides in an ignition apparatus for an internal combustion engine which includes: a casing; an ignition coil having an iron core disposed in the casing to form a closed magnetic circuit, and a primary coil and a secondary coil installed on a part of the iron core; a power switch for controlling electric power to be supplied to the primary coil; a low-voltage side connector having a terminal electrically connected with the power switch; and a high-voltage side connector having a high-voltage terminal electrically connected with the secondary coil. The casing includes: a casing main body that accommodates the part of the iron core, the primary coil, the secondary coil and the power switch; and a cover integrally formed with the casing main body for covering a part of the iron core located outside of the casing main body.

In the ignition coil apparatus for an internal combustion engine according to the present invention, even if a high-voltage cable falls off from the high-voltage side connector, there will be no discharge generated between the high-voltage terminal and the iron core. In addition, the overall height of the apparatus can be reduced, and there is no necessity of applying a painting treatment to the surface of the iron core as a corrosion protection measure.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described below in detail while referring to the accompanying drawings. The following description will be made by identifying the same members and parts or corresponding members and parts with the same symbols.

Embodiment 1.

Figure 1:
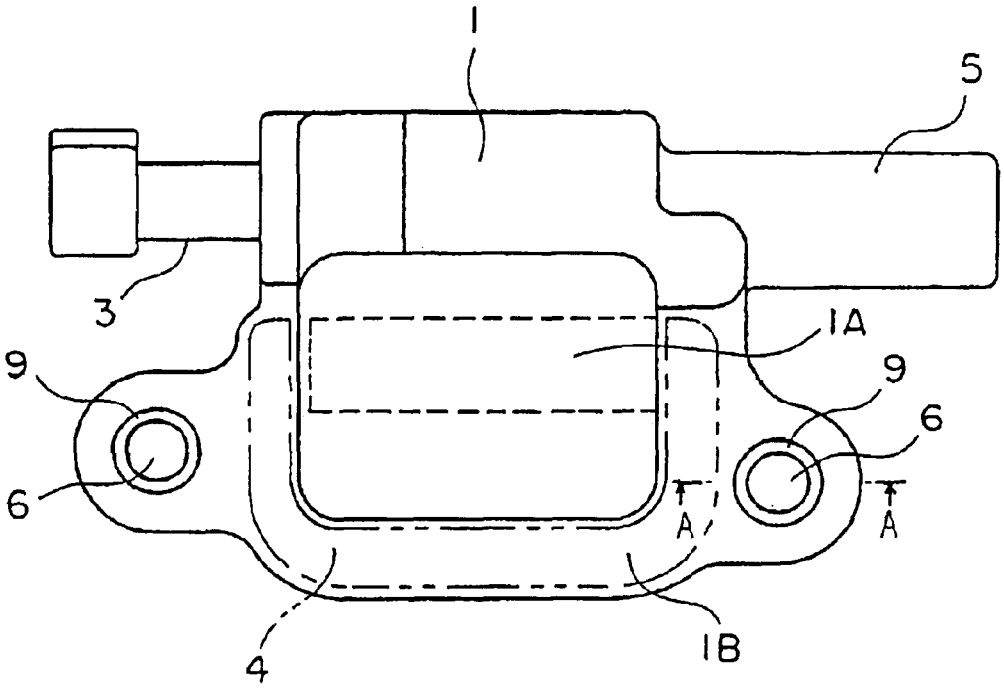
FIG. 1 is a plan view of an ignition coil apparatus for an internal combustion engine according to a first embodiment of the present invention.
Figure 2:
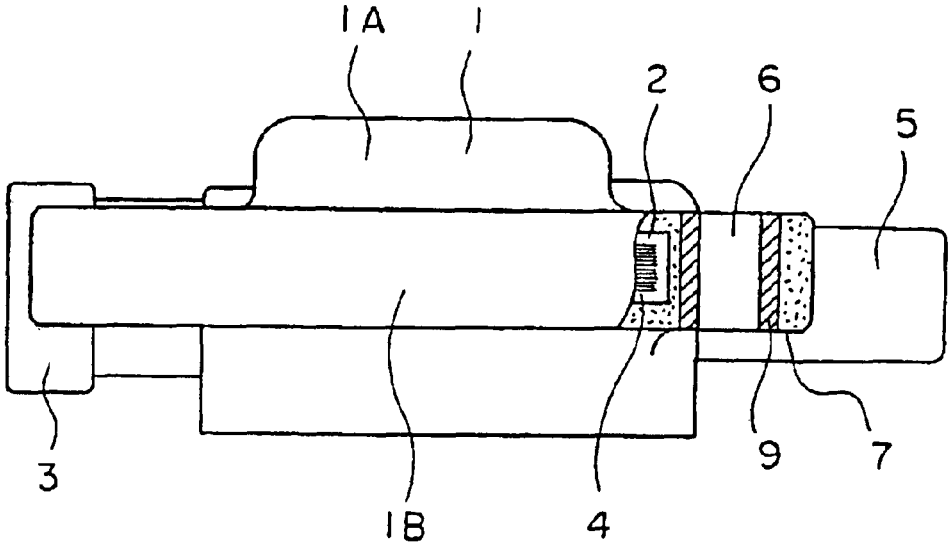
FIG. 2 is a partially cut-away side elevation of the ignition coil apparatus for an internal combustion engine along line A—A in FIG. 1.

FIG. 1 is a plan view of an ignition coil apparatus for an internal combustion engine (hereinafter abbreviated as an ignition coil apparatus) according to a first embodiment of the present invention, and FIG. 2 is a partially cut-away side elevation of the ignition coil apparatus along line A—A in FIG. 1.

This ignition coil apparatus includes a casing 1 molded from a resin material such as, for example, a PBT resin, an ignition coil 2 arranged in the casing 1, a power switch (not shown) received in the casing 1 and having a power transistor (not shown) and an integrated circuit for driving and controlling the power transistor solidly sealed in the casing 1 with a resin by means of insert molding, and a low-voltage side connector 3 with an insert molded terminal electrically connected with the power switch.

The ignition coil 2 includes a hollow-rectangular-shaped iron core 4 that forms a closed magnetic circuit, a primary coil (not shown) arranged to enclose one side of the iron core 4 and having a primary winding wound around a first bobbin, and a secondary coil (not shown) arranged outside of the primary coil in a concentric relation and having a secondary coil wound around a second bobbin. A high-voltage terminal electrically connected with the secondary coil is insert molded with a resin to form a high-voltage tower 5 that constitutes a high-voltage side connector.

The casing 1 is constructed of a casing main body 1A accommodating therein the power switch, part of the iron core 4, the primary coil and the secondary coil, and a cover 1B integrally formed with the casing main body 1A so as to cover those portions of the iron core 4 which are located outside of the casing main body 1A. The cover 1B is formed simultaneously with the injection molding of the casing main body 1A. The cover 1B has a pair of fastening holes 6 formed therethrough at its opposite sides, by the use of which the cover 1B can be fixedly fastened to a fixed part such as an engine proper, a bracket or the like, each fastening hole 6 having a fastening bearing surface 7 at one side thereof to be fastened to the fixed part. A cylindrical bush 9 made of aluminum is fitted into each of the fastening holes 6.

The high-voltage tower 5 has its axis extending in the same direction as an axial direction of the low-voltage side connector 3. In addition, the high-voltage tower 5 and the low-voltage side connector 3 are arranged in parallel with respect to the fastening bearing surfaces 7 of the fastening holes 6 and in an overlapped relation with respect with each other when viewed along the fastening bearing surfaces 7. The high-voltage tower 5 and the low-voltage side connector 3 have substantially the same height from the fastening bearing surfaces 7.

With the ignition coil apparatus as constructed above, the power transistor of the power switch is turned off in synchronization with the ignition timing of the internal combustion engine to interrupt the primary current of the primary coil, so that a high voltage is induced in the secondary coil to supply a high-voltage current to spark plugs through the high-voltage terminal of the high-voltage tower 5.

According to the ignition coil apparatus as constructed above, those portions of the iron core 4 located outside of the casing main body 1A are covered with the cover 1B formed integral with the casing main body 1A. Thus, even if the high-voltage tower 5 and the iron core 4 are placed in proximity with each other, there will be caused no discharge between the high-voltage terminal of the high-voltage tower 5 and the iron core 4. As a result, the overall height of the ignition coil apparatus can be lowered, thereby making it possible to improve the degree of freedom in the installation thereof in an engine compartment. In addition, no part of the iron core 4 is exposed to air, and hence there is no necessity of applying a painting treatment to the surface of the iron core 4 for corrosion protection.

Embodiment 2.

Figure 3:
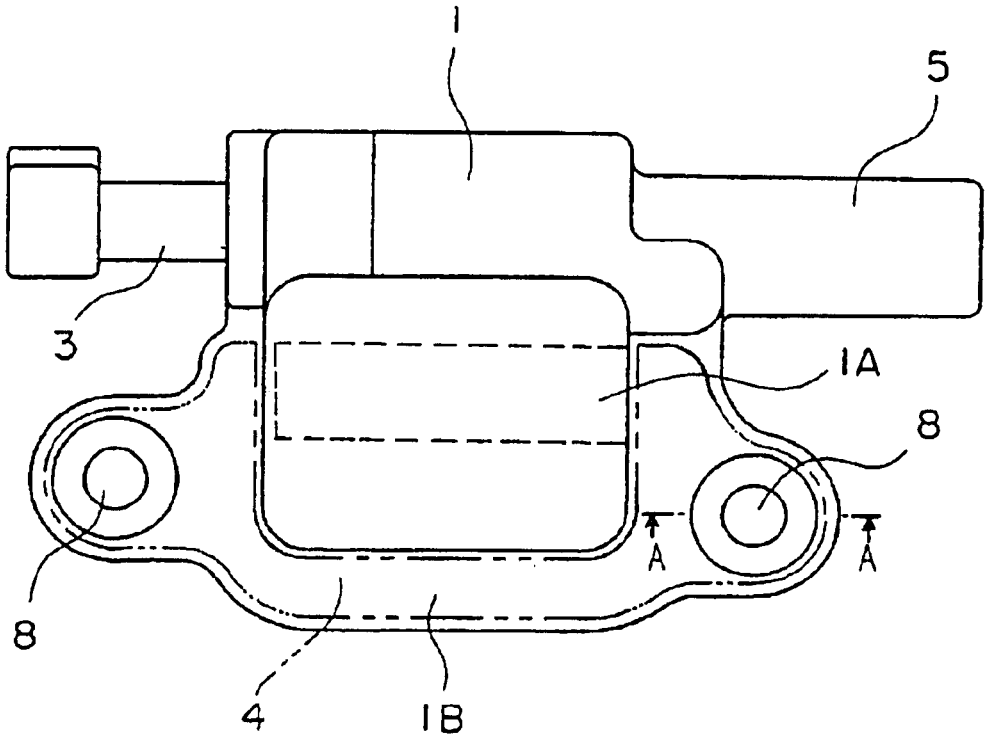
FIG. 3 is a plan view of an ignition coil apparatus for an internal combustion engine according to a second embodiment of the present invention.
Figure 4:
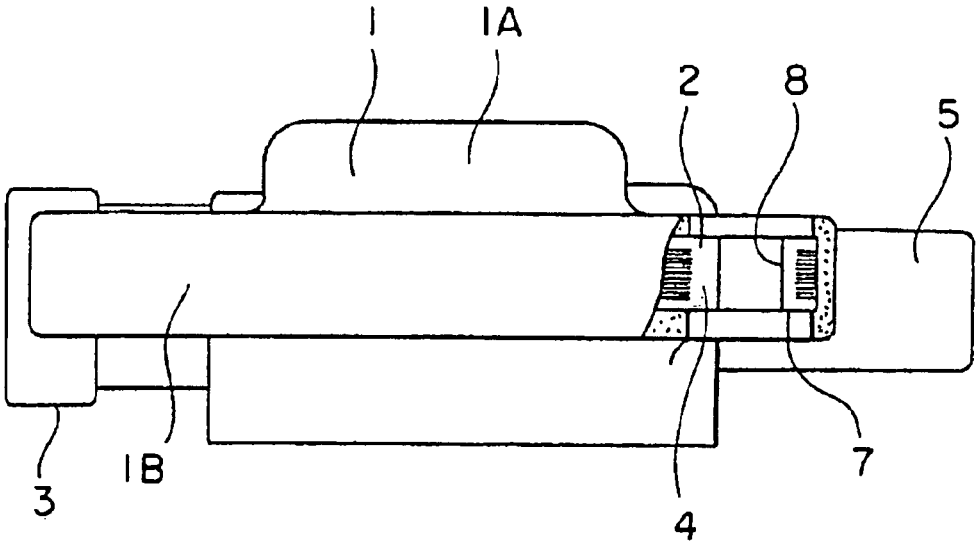
FIG. 4 is a partially cut-away side elevation of the ignition coil apparatus for an internal combustion engine along line A—A in FIG. 3.

FIG. 3 is a plan view of an ignition coil apparatus for an internal combustion engine according to a second embodiment of the present invention, and FIG. 4 is a partially cut-away side elevation of the ignition coil apparatus along line A—A in FIG. 3.

This embodiment is different from the above-mentioned first embodiment in that a pair of fastening holes 8 extending through the iron core 4 are formed through the cover 1B at its opposite sides.

Thus, in contrast to the first embodiment in which the fastening holes 6 are formed through the cover 1B made of resin, the fastening holes 8 in this second embodiment are formed in the cover 1B so as to extend through the iron core 4. With such an arrangement, the ignition coil apparatus is strongly fastened to the fixed portion by use of the fastening holes 8.

Embodiment 3.

Figure 5:
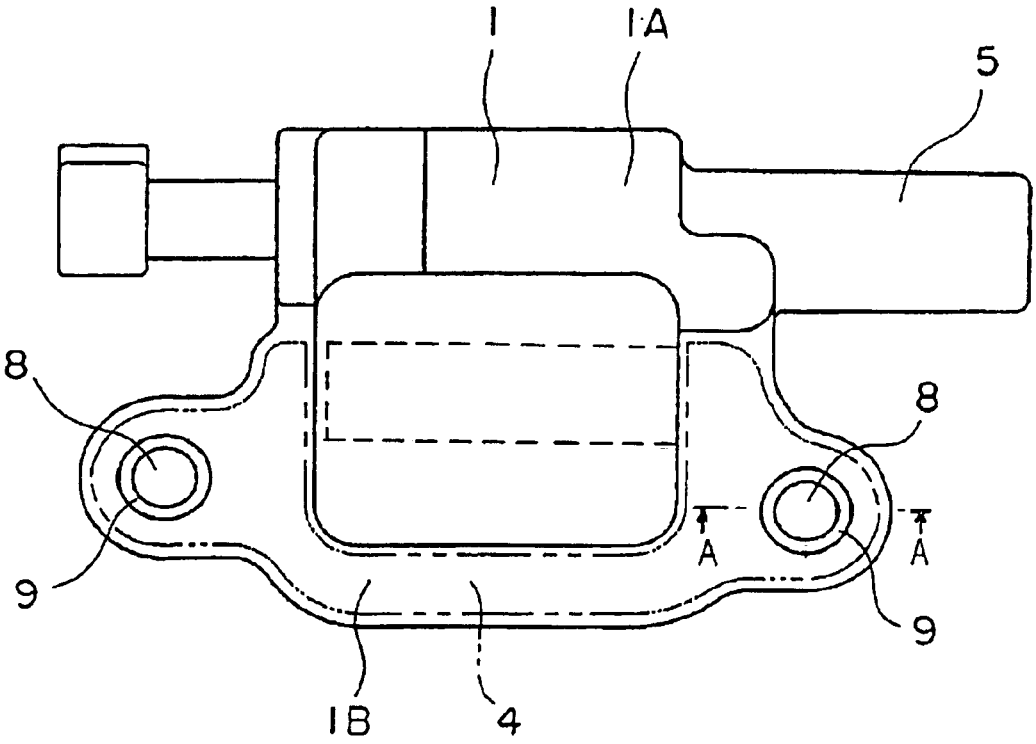
FIG. 5 is a plan view of an ignition coil apparatus for an internal combustion engine according to a third embodiment of the present invention.
Figure 6:
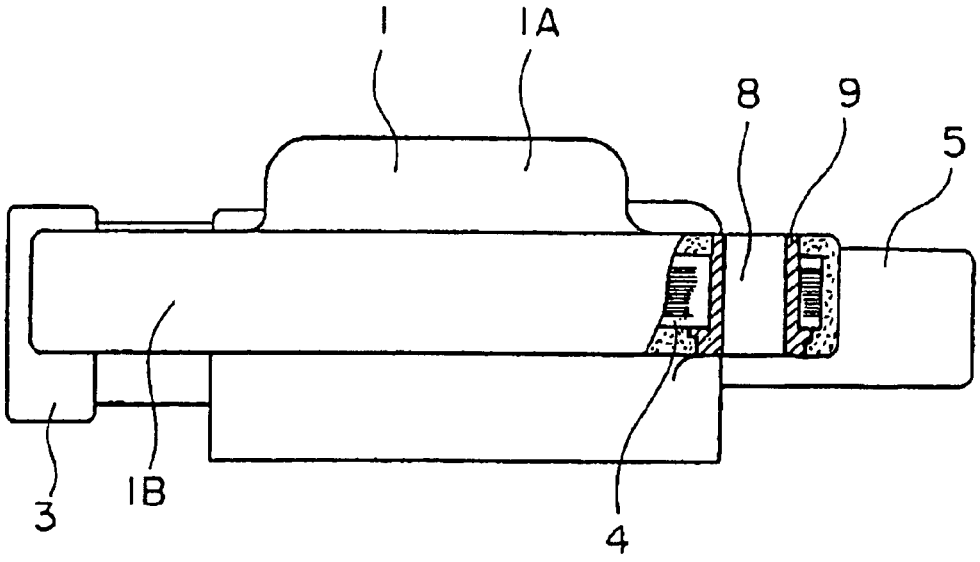
FIG. 6 is a partially cut-away side elevation of the ignition coil apparatus for an internal combustion engine along line A—A in FIG. 5.

FIG. 5 is a plan view of an ignition coil apparatus for an internal combustion engine according to a third embodiment of the present invention, and FIG. 6 is a partially cut-away side elevation of the ignition coil apparatus along line A—A in FIG. 5.

This embodiment is different from said second embodiment in that a bush 9 made of a corrosion-resistant material such as, for example, aluminum is press-fitted into a corresponding fastening hole 8 which is formed through the cover 1B so as to extend through the iron core 4.

Thus, in this third embodiment, the ignition coil apparatus is strongly fastened to the fixed part, and at the same time the inner wall surface of each fastening hole 8 is not exposed to air, thereby making it possible to prevent corrosion in the fastening hole 8.

Embodiment 4.

Figure 7:
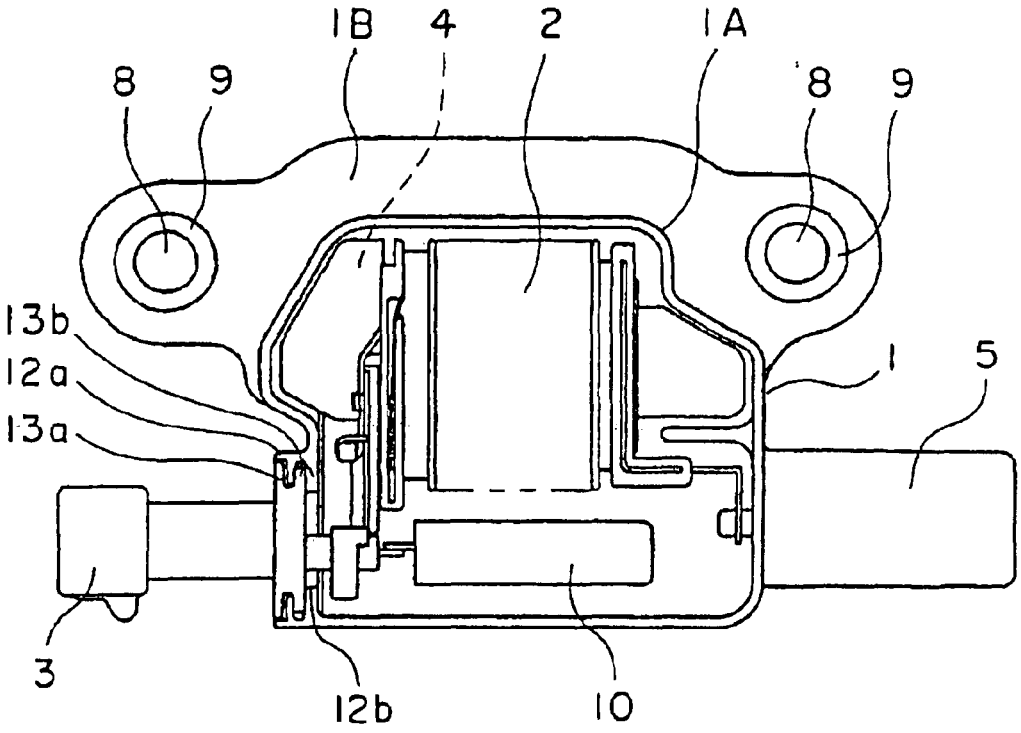
FIG. 7 is a plan view of an ignition coil apparatus for an internal combustion engine according to a fourth embodiment of the present invention showing the state before a thermosetting resin is poured into a casing.
Figure 8:
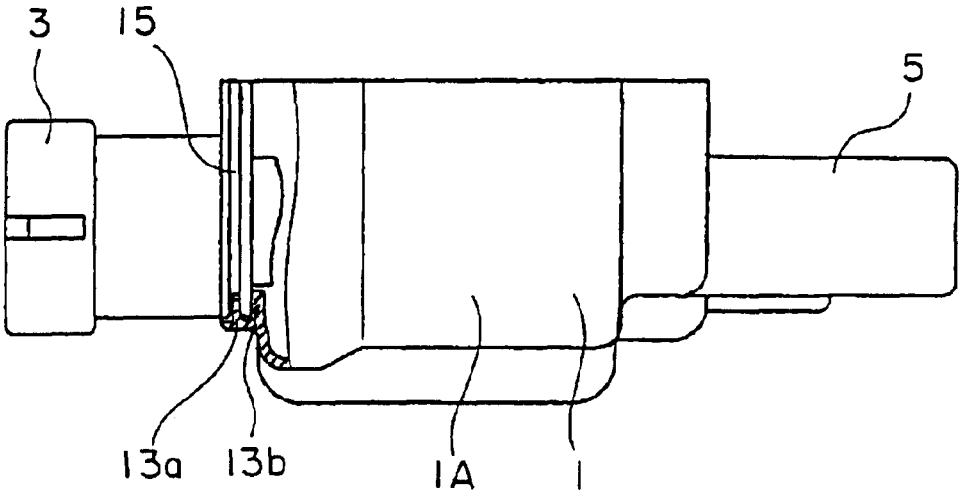
FIG. 8 is a side elevation of the ignition coil apparatus for an internal combustion engine with part of the casing of FIG. 7 being cut away.

FIG. 7 is a plan view of an ignition coil apparatus for an internal combustion engine according to a fourth embodiment of the present invention, showing the state before a thermosetting resin is poured into the casing 1, and FIG. 8 is a side elevation of the same with part of the casing 1 of FIG. 7 being cut away.

In this ignition coil apparatus, the ignition coil 2 and the power switch 10 are received in the casing 1 while being arranged in parallel with each other. The power switch 10 is formed integrally with the low-voltage side connector 3, and double grooves 12*a*, 12*b* are formed in the outer peripheral portion of the low-voltage side connector 3. Double protrusions 13*a*, 13*b* formed on the notch portion 15 of the casing 1 are placed in engagement with the grooves 12*a*, 12*b* to provide a seal between the casing 1 and the low-voltage side connector 3.

Here, note that the grooves 12*a*, 12*b* and the protrusions 13*a*, 13*b* together constitute a seal unit.

In this fourth embodiment, the primary coil, the secondary coil integral with the primary coil, and the power switch 10 integral with the low-voltage side connector 3 are first assembled respectively in places outside of the casing 1, and then they are assembled or received into the casing 1. Thereafter, an electrically insulating thermoplastic resin in the form of an epoxy resin is poured into the casing 1 and solidified there, so that the casing 1, the ignition coil 2, the low-voltage side connector 3 and the power switch 10 are integrated coupled with one another.

Here, note that a portion of the inner surface of the casing 1 corresponding to the iron core 4 is beforehand covered by the thermoplastic resin. Accordingly, the thermoplastic resin is interposed between the iron core 4 and the thermosetting resin, so that it is possible to reduce the generation of a crack due to thermal stress of the thermosetting resin resulting from the heat generation of the iron core 4 during operation of the ignition coil apparatus.

According to the coil ignition device of this fourth embodiment, the seal unit is arranged between the casing 1 and the low-voltage side connector 3, so that an insulating resin, when poured into the casing 1, is prevented from leaking outside of the casing 1 under the action the seal unit.

In addition, when the casing 1 is formed, a portion of the cover 1B corresponding to the iron core 4 is integrally coupled with the casing 1 by means of insert injection molding. As a result, the primary coil, the secondary coil formed integral with the primary coil, and the power switch 10 formed integral with the low-voltage side connector 3 are respectively assembled in places outside of the casing 1, thereby improving the assemblability of the apparatus.

Moreover, in the ignition coil apparatus of the above construction, when fastened to the fixed part with a resin-pouring opening side thereof being directed downward, there is no fear that water might invade into the casing 1 along the inner wall surface of the casing 1.

Embodiment 5.

Figure 9:
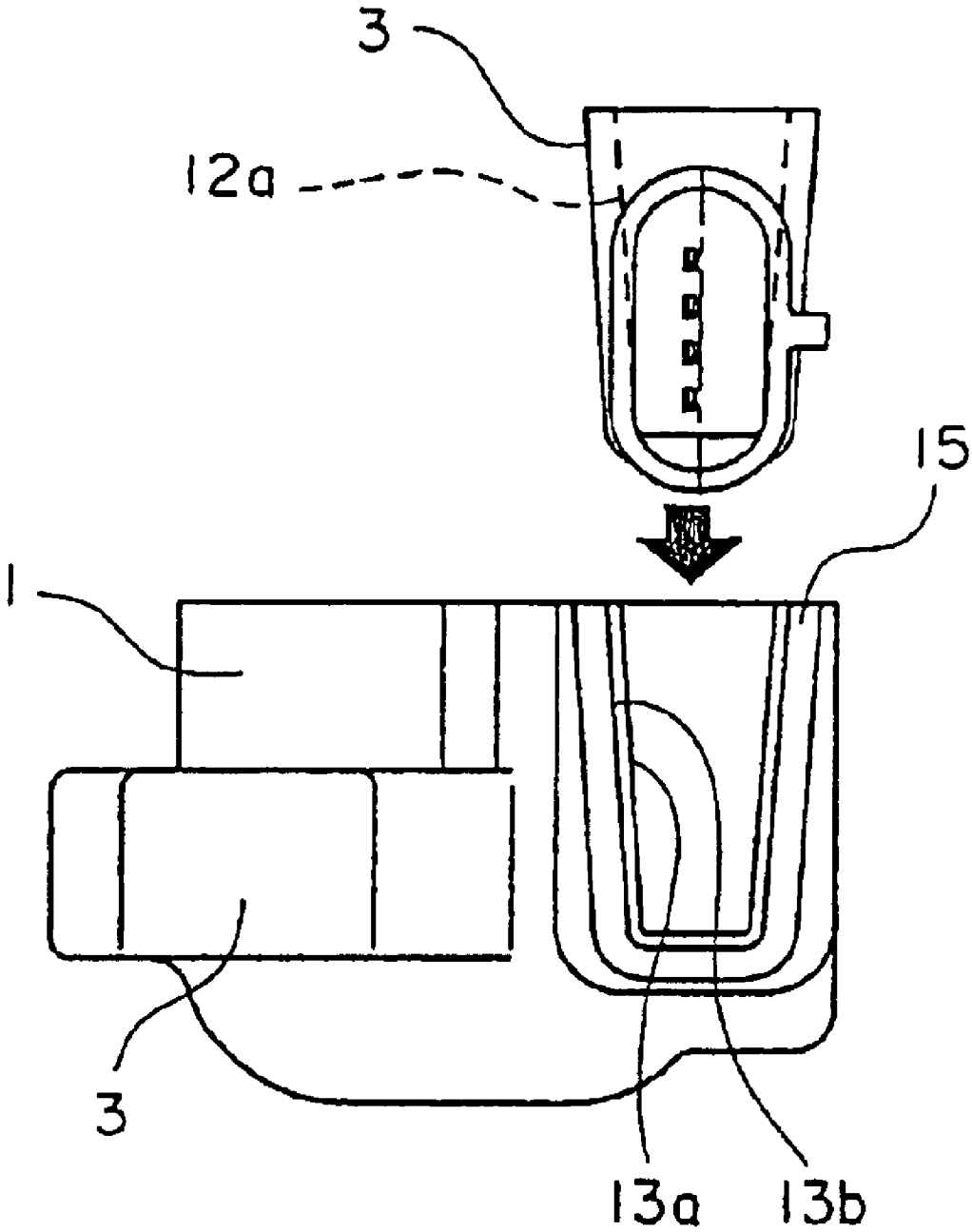
FIG. 9 is a view of an ignition coil apparatus for an internal combustion engine according to a fifth embodiment of the present invention, showing the state in which a low-voltage side connector is being mounted to a casing.

FIG. 9 is a view of an ignition coil apparatus for an internal combustion engine according to a fifth embodiment of the present invention, showing the state of the low-voltage side connector 3 being assembled into the casing 1.

In this embodiment, double protrusions 13*a*, 13*b* are formed on the notch portion 15 of the casing 1 into which the low-voltage side connector 3 is fitted. The notch portion 15 has a V-shaped configuration diverging toward an opening side thereof. Double grooves 12*a*, 12*b*, into which the protrusions 13*a*, 13*b* are fitted, are formed in the outer peripheral surface of the low-voltage side connector 3.

The notch portion 15 is formed into a U-shaped configuration diverging toward an opening side thereof, so the low-voltage side connector 3 can be smoothly fitted into the notch portion 15 of the casing 1. In addition, since the grooves 12*a*, 12*b* and the protrusions 13*a*, 13*b*, which together constitute a seal unit, are of double structures, respectively, the seal unit has high sealing performance.

Although in the above-mentioned fourth and fifth embodiments the seal unit comprises the grooves 12*a*, 12*b* formed in the low-voltage side connector 3 and the protrusions 13*a*, 13*b* formed on the casing 1, the present invention is not, of course, limited to this one. For example, protrusions may be formed on the low-voltage side connector, and grooves, into which the protrusions are fitted, may be formed in the casing.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

a casing;

an ignition coil having an iron core disposed in said casing to form a closed magnetic circuit, and a primary coil and a secondary coil installed on a part of said iron core;

a power switch for controlling electric power to be supplied to said primary coil;

a low-voltage side connector having a terminal electrically connected with said power switch; and a high-voltage side connector having a high-voltage terminal electrically connected with said secondary coil;

wherein said casing comprises:

a casing main body that accommodates said part of said iron core, said primary coil, said secondary coil, and said power switch; and a cover integrally formed with said casing main body for covering a part of said iron core located outside of said casing main body;

wherein a same chamber of said casing main body accommodates said part of said iron core, said primary coil, said secondary coil, and said power switch.

2. The ignition coil apparatus for an internal combustion engine as set forth in claim 1, wherein said cover is provided with a fastening hole having a fastening bearing surface for fastening said cover to a fixed part, and said high-voltage side connector and said low-voltage side connector are disposed in parallel with respect to said fastening bearing surface of said fastening hole and in an overlapped relation with each other when viewed along the fastening bearing surface.

3. The ignition coil apparatus for an internal combustion engine according to claim 2, wherein said fastening hole are formed through said iron core.

4. The ignition coil apparatus for an internal combustion engine as set forth in claim 3, wherein a bush covering an inner wall surface of said iron core fitted in said fastening hole.

5. The ignition coil apparatus for an internal combustion engine as set forth in claim 1, wherein a notch portion, into which said low-voltage side connector is fitted, is formed in said casing, and a seal unit for preventing an electrically insulating thermosetting resin poured into said casing from leaking outside therefrom is disposed between said notch portion and said low-voltage side connector.

6. The ignition coil apparatus for an internal combustion engine as set forth in claim 5, wherein said seal unit includes protrusions formed on said notch portion, and grooves formed in said low-voltage side connector so as to engage with said protrusions.

7. The ignition coil apparatus for an internal combustion engine as set forth in claim 6, wherein said notch portion has a V-shaped configuration diverging toward an opening side thereof.

8. An ignition apparatus for an internal combustion engine comprising:

a casing;

an ignition coil having an iron core disposed in said casing to form a closed magnetic circuit, and a primary coil and a secondary coil installed on a part of said iron core;

a power switch for controlling electric power to be supplied to said primary coil;

a low-voltage side connector having a terminal electrically connected with said power switch; and a high-voltage side connector having a high-voltage terminal electrically connected with said secondary coil;

wherein said casing comprises:

a casing main body that accommodates said part of said iron core, said primary coil, said secondary coil and said power switch; and a cover integrally formed with said casing main body for covering a part of said iron core located outside of said casing main body;

wherein a notch portion, into which said low-voltage side connector is fitted, is formed in said casing, and a seal unit for preventing an electrically insulating thermosetting resin poured into said casing from leaking outside therefrom is disposed between said notch portion and said low-voltage side connector.

9. The ignition coil apparatus for an internal combustion engine as set forth in claim 8, wherein said seal unit includes protrusions formed on said notch portion, and grooves formed in said low-voltage side connector so as to engage with said protrusions.

10. The ignition coil apparatus for an internal combustion engine as set forth in claim 9, wherein said notch portion has a V-shaped configuration diverging toward an opening side thereof.

* * * * *